US010087509B2

(12) United States Patent
Wang et al.

(10) Patent No.: US 10,087,509 B2
(45) Date of Patent: Oct. 2, 2018

(54) SPHEROIDAL GRAPHITE CAST IRON HAVING EXCELLENT STRENGTH AND TOUGHNESS AND ITS PRODUCTION METHOD

(71) Applicant: HITACHI METALS, LTD., Minato-ku, Tokyo (JP)

(72) Inventors: Lin Wang, Moka (JP); Masahide Kawabata, Moka (JP); Kentaro Fukumoto, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 969 days.

(21) Appl. No.: 14/369,497

(22) PCT Filed: Dec. 28, 2012

(86) PCT No.: PCT/JP2012/084215
§ 371 (c)(1),
(2) Date: Jun. 27, 2014

(87) PCT Pub. No.: WO2013/100148
PCT Pub. Date: Jul. 4, 2013

(65) Prior Publication Data

US 2014/0352851 A1 Dec. 4, 2014

(30) Foreign Application Priority Data

Dec. 28, 2011 (JP) ..... 2011-288986

(51) Int. Cl.

| | |
|---|---|
| ***C22C 37/04*** | (2006.01) |
| ***C21D 5/00*** | (2006.01) |
| ***C22C 33/10*** | (2006.01) |
| ***C22C 33/08*** | (2006.01) |
| ***C22C 37/10*** | (2006.01) |

(52) U.S. Cl.
CPC ..... *C22C 37/04* (2013.01); *C21D 5/00* (2013.01); *C22C 33/08* (2013.01); *C22C 33/10* (2013.01); *C22C 37/10* (2013.01); *C21D 2211/005* (2013.01); *C21D 2211/006* (2013.01); *C21D 2211/009* (2013.01)

(58) Field of Classification Search
CPC ..... C22C 37/04; C21D 5/00
USPC ..... 148/321
See application file for complete search history.

(56) References Cited

U.S. PATENT DOCUMENTS

| | | | | |
|---|---|---|---|---|
| 4,099,994 | A | 7/1978 | Ikawa et al. | |
| 5,346,561 | A | 9/1994 | Obata et al. | |
| 5,876,523 | A * | 3/1999 | Nagayoshi | C21D 5/00 148/614 |

FOREIGN PATENT DOCUMENTS

| | | | |
|---|---|---|---|
| JP | 51-123719 | A | 10/1976 |
| JP | 586922 | A | 1/1983 |
| JP | 2173240 | A | 7/1990 |
| JP | 08-13079 | A | 1/1996 |
| JP | 2001-214233 | A | 8/2001 |
| JP | 2002-317238 | A | 10/2002 |
| JP | 2009-001865 | A | 1/2009 |
| JP | 2010-189706 | A | 9/2010 |

OTHER PUBLICATIONS

International Search Report of PCT/JP2012/084215 dated Mar. 26, 2013.
Communication dated Jun. 17, 2015 from the European Patent Office in application No. 12861849.3.
Martin Selin et al: "Regression Analysis of Thermal Conductivity Based on Measurements of Compacted Graphite Irons", Metallurgical and Materials Transactions A, Springer-Verlag, New York, vol. 40, No. 13, Sep. 25, 2009 (Sep. 25, 2009), pp. 3235-3244, XP019754938, ISSN: 1543-1940, DOI:10.1007/S11661-009-0042-8.

* cited by examiner

*Primary Examiner* — Weiping Zhu
(74) *Attorney, Agent, or Firm* — Sughrue Mion, PLLC

(57) ABSTRACT

A spheroidal graphite cast iron having (a) a composition comprising by mass 3.4-4% of C, 1.9-2.8% of Si, 0.02-0.06% of Mg, 0.2-1% of Mn, 0.2-2% of Cu, 0-0.1% of Sn, 0.85-3% of (Mn+Cu+10×Sn), 0.05% or less of P, and 0.02% or less of S, the balance being Fe and inevitable impurities, and (b) a duplex matrix structure comprising by area 2-40% of fine ferrite phases and 60-98% of fine pearlite phases, the maximum length of the ferrite phases being 300 μm or less, and (c) the pearlite phases being formed around graphite particles dispersed in the duplex matrix structure.

5 Claims, 2 Drawing Sheets

SPHEROIDAL GRAPHITE CAST IRON HAVING EXCELLENT STRENGTH AND TOUGHNESS AND ITS PRODUCTION METHOD

CROSS REFERENCE TO RELATED APPLICATIONS

This is a National Stage of International Application No. PCT/JP2012/084215 filed Dec. 28, 2012 (claiming priority based on Japanese Patent Application No. 2011-288986 filed Dec. 28, 2011), the contents of which are incorporated herein by reference in their entirety.

FIELD OF THE INVENTION

The present invention relates to a spheroidal graphite cast iron having excellent strength and toughness and its production method.

BACKGROUND OF THE INVENTION

Because spheroidal graphite cast irons have excellent mechanical properties and good castability, they are widely used for parts for various machines and automobiles. Among them, suspension parts for automobiles such as suspension arms, steering knuckles, etc. are required to have sufficient static strength and fatigue strength for supporting automobile bodies, as well as enough impact resistance to avoid breakage even under impact due to accidents, etc. Because automobiles are used in cold areas, too, it is important for them to have enough impact resistance at low temperatures, for example, −30° C. Accordingly, spheroidal graphite cast irons for suspension parts are required to have sufficient elongation and toughness such as low-temperature impact strength, etc., in addition to high tensile strength and yield strength. To meet such demands, FCD400, FCD450, etc. defined by JIS G 5502 have conventionally been used as spheroidal graphite cast irons having a ferrite-based matrix structure for high toughness.

To prevent global warming, the reduction of $CO_2$ emission from automobiles has recently been strongly demanded. To this end, automobiles should be provided with improved fuel efficiency, and one of measures therefor is the weight reduction of suspension parts, etc. To reduce the weight of parts while keeping necessary strength, the size reduction and thinning of parts are effective. For this purpose, it may be contemplated to use pearlitic, spheroidal graphite cast irons such as FCD600, FCD700, etc. having higher strength than that of FCD400, FCD450, etc., but FCD600, FCD700, etc. have low toughness, not suitable for suspension parts requiring high impact resistance, because strength and toughness are contradictory properties in spheroidal graphite cast irons. To achieve the weight reduction of suspension parts while keeping their strength and toughness, spheroidal graphite cast irons excellent in both strength and toughness are required.

To obtain spheroidal graphite cast irons having excellent strength and toughness, various proposals have been made conventionally. For example, JP 2001-214233 A proposes a spheroidal graphite cast iron member having as thin-wall portions as 1 cm or less, which is made of a spheroidal graphite cast iron containing 0.5-1% by mass of Cu, and has a surface layer whose matrix has a ferritization ratio of 60% or more, and an inner portion whose matrix is mostly composed of pearlite phases, the surface layer being substantially as thick as 0.05-0.45 mm on the entire as-cast surface, whereby the spheroidal graphite cast iron member has high rigidity and impact resistance. In this spheroidal graphite cast iron member, toughness is obtained from a surface layer as thick as 0.05-0.45 mm with a large proportion of ferrite phases, while strength is obtained from an inner portion composed of a pearlite phase. However, because it is made of conventional pearlitic spheroidal graphite cast iron such as FCD600, FCD700, etc. to have high strength inside, it has low toughness. In addition, when the thickness of a thin ferrite surface layer is reduced by local wear and oxidation, it unlikely keeps toughness necessary for suspension parts.

JP 8-13079 A proposes a method for producing a spheroidal graphite cast iron having ferrite phases in a network pattern along pearlitic crystal grain boundaries for having high strength and toughness, which comprises the steps of heating a spheroidal graphite cast iron comprising by weight 3.0-4.0% of C, 1.5-3.0% of Si, 1.0% or less of Mn, 0.030% or less of P, 0.020% or less of S, less than 1.0% of Cu, and 0.02-0.08% of Mg, the balance being iron, to an austenization temperature $T_1$ (870° C. or higher), holding the spheroidal graphite cast iron at $T_1$ for a predetermined period of time (for example, 2 hours), cooling it to a predetermined temperature $T_2$ (750-850° C.) within a eutectoid transformation temperature range, holding it at $T_2$ for a predetermined period of time (for example, 1 hour), and then cooling it with air to room temperature. However, because the holding temperature $T_1$ for austenization is as high as 870° C. or higher (930° C. in Examples), and because the holding time is as long as 2 hours, austenite crystal grains, which are transformed to pearlite crystal grains by cooling, may be made coarser, resulting in low toughness. Also, because low-strength ferrite phases formed along crystal grain boundaries act as crack-propagating paths, it unlikely has sufficient strength.

OBJECT OF THE INVENTION

Accordingly, an object of the present invention is to provide a spheroidal graphite cast iron having excellent strength and toughness, and its production method.

DISCLOSURE OF THE INVENTION

As a result of intensive research on the alloy compositions and heat treatment conditions of spheroidal graphite cast irons in view of the above object, the inventors have found that (a) the optimization of the amounts of Mn, Cu and Sn as pearlite phase-stabilizing elements, and (b) the restriction of the holding temperature and time in the austenization temperature span and the cooling rate in the eutectoid transformation range to predetermined ranges as heat treatment conditions, provide a spheroidal graphite cast iron having a duplex matrix structure comprising by area 2-40% of fine ferrite phases and 60-98% of fine pearlite phases, the maximum length of the ferrite phases being 300 μm or less, and the pearlite phases being formed around graphite particles dispersed in the duplex matrix structure, thereby having excellent strength and toughness. The present invention has been completed based on such finding.

Thus, the spheroidal graphite cast iron of the present invention having excellent strength and toughness has (a) a composition comprising by mass 3.4-4% of C, 1.9-2.8% of Si, 0.02-0.06% of Mg, 0.2-1% of Mn, 0.2-2% of Cu, 0-0.1% of Sn, 0.85-3% of (Mn+Cu+10×Sn), 0.05% or less of P, and 0.02% or less of S, the balance being Fe and inevitable impurities; and (b) a duplex matrix structure comprising by area 2-40% of fine ferrite phases and 60-98% of fine pearlite phases, the maximum length of the ferrite phases being 300 μm or less; and (c) the pearlite phases being formed around graphite particles dispersed in the duplex matrix structure.

The number ratio of graphite particles each having a pearlite-surrounded ratio (defined as a percentage of the total length of peripheral portions of each graphite particle in contact with pearlite phases to its entire peripheral length) of 50-95% is preferably 50% or more based on the total number of graphite particles per a unit area.

The spheroidal graphite cast iron of the present invention preferably has tensile strength, as an indicator of strength, of 650 MPa or more, and impact strength, as an indicator of toughness, of 30 J/cm$^2$ or more by a notchless Charpy impact test at −30° C.

The method of the present invention for producing a spheroidal graphite cast iron having excellent strength and toughness comprises the steps of (1) casting and solidifying a melt having a composition comprising by mass 3.4-4% of C, 1.9-2.8% of Si, 0.02-0.06% of Mg, 0.2-1% of Mn, 0.2-2% of Cu, 0-0.1% of Sn, 0.85-3% of (Mn+Cu+10×Sn), 0.05% or less of P, and 0.02% or less of S, the balance being Fe and inevitable impurities; and (2) conducting a heat treatment comprising a step (i) of holding the resultant casting at a temperature at which an entire matrix of the casting is austenized, to form fine austenite crystal grains, which are transformed to pearlite crystal grains by cooling, and a step (ii) of cooling the casting at a cooling rate of forming fine ferrite phases in a predetermined temperature range within a temperature span in which eutectoid transformation occurs, thereby forming a duplex matrix structure comprising by area 2-40% of fine ferrite phases and 60-98% of fine pearlite phases, the maximum length of the ferrite phases being 300 μm or less, and the pearlite phases being formed around graphite particles dispersed in the duplex matrix structure.

In the method of the present invention for producing a spheroidal graphite cast iron, the austenizing heat treatment conditions for forming fine austenite crystal grains are preferably 800-865° C. and 5-30 minutes, the predetermined temperature range within a eutectoid-transformation-causing temperature span is preferably 750-670° C., and the cooling rate in such temperature range is preferably 1-20° C./minute.

DESCRIPTION OF THE PREFERRED EMBODIMENTS

Figure 1:
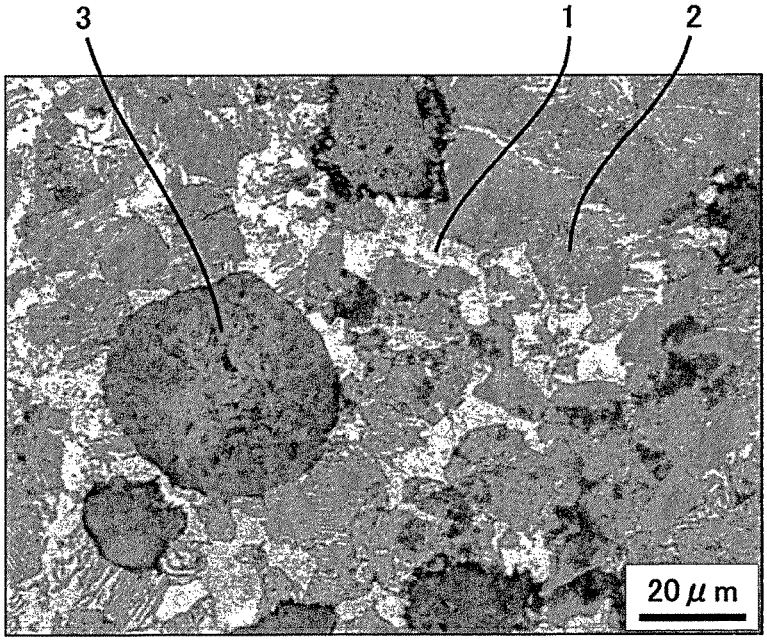
FIG. 1 is an optical photomicrograph showing the structure of the spheroidal graphite cast iron of the present invention.

The spheroidal graphite cast iron of the present invention and its production method will be explained in detail below. Unless otherwise mentioned particularly, the amount of each element constituting the alloy is expressed by "% by mass."

[A] Composition of Spheroidal Graphite Cast Iron (1) C, 3.4-4%

C is necessary not only for lowering the solidification-starting temperature to improve castability, but also for crystallizing graphite and precipitating pearlite phases. Less than 3.4% of C likely causes chilling, providing the spheroidal graphite cast iron with low toughness, while more than 4% of C tends to generate abnormal graphite, providing the spheroidal graphite cast iron with low strength. Accordingly, the C content is 3.4-4%. The preferred C content is 3.6-3.8%.

(2) Si: 1.9-2.8%

Si is necessary for promoting the crystallization of graphite, and increasing the fluidity of a melt. Less than 1.9% of Si likely causes chilling, providing the spheroidal graphite cast iron with poor machinability and toughness, while more than 2.8% of Si highly suppresses pearlitization, providing the spheroidal graphite cast iron with low strength, and deteriorating the low-temperature toughness of ferrite phases. Accordingly, the Si content is 1.9-2.8%. The preferred Si content is 2.0-2.6%.

(3) Mg: 0.02-0.06%

Mg is an element necessary for the spheroidization of graphite, though less than 0.02% of Mg fails to provide a sufficient effect of spheroidizing graphite. On the other hand, more than 0.06% of Mg likely causes chilling, providing the spheroidal graphite cast iron with poor machinability and low-temperature toughness. Accordingly, the Mg content is 0.02-0.06%. The preferred Mg content is 0.03-0.05%.

(4) Mn: 0.2-1%

Mn is an element inevitably introduced from starting materials, which acts to crystallize pearlite phases as a pearlite phase-stabilizing element. Less than 0.2% of Mn cannot form pearlite phases sufficiently, failing to obtain necessary strength such as tensile strength, yield strength, etc. Up to 1% of Mn is permitted to promote pearlitization, but more than 1% of Mn causes extreme chilling, providing the spheroidal graphite cast iron with poor machinability and toughness. Accordingly, the Mn content is 0.2-1%. The Mn content is preferably 0.4-0.8%, more preferably 0.5-0.7%.

(5) Cu: 0.2-2%

Cu is a pearlite phase-stabilizing element necessary for crystallizing pearlite phases. During heat treatment, Cu exhibits a barrier effect in interfaces between graphite particles and the matrix for suppressing the diffusion of carbon from austenite phases to graphite particles, thereby retarding the transformation of austenite phases to ferrite phases, and thus suppressing the crystallization and growth of ferrite phases. Less than 0.2% of Cu fails to form pearlite phases sufficiently, providing the spheroidal graphite cast iron with low tensile strength, while more than 2% of Cu makes the spheroidal graphite cast iron too hard, and hinders the spheroidization of graphite, providing the spheroidal graphite cast iron with poor elongation and impact properties. Accordingly, the Cu content is 0.2-2%. The Cu content is preferably 0.4-2%, more preferably 0.5-1%.

(6) Sn: 0-0.1%

Though Sn is not an indispensable element in the present invention, it may be added together with Mn and Cu, because it is a pearlite phase-stabilizing element acting like Mn and Cu to crystallize pearlite phases. 0.005% or more of Sn promotes pearlitization, providing the spheroidal graphite cast iron with improved strength and hardness. However, more than 0.1% of Sn hinders the spheroidization of graphite, and lowers toughness such as low-temperature impact strength by segregation in eutectic cell boundaries. When Sn is contained, its content is 0.005-0.1%. The Sn content is preferably 0.005-0.02%, more preferably 0.005-0.01%.

(7) (Mn+Cu+10×Sn): 0.85-3%

With respect to the pearlite phase-stabilizing elements, the spheroidal graphite cast iron of the present invention should meet the condition of (Mn+Cu+10×Sn)=0.85-3%. In this formula, the symbol of each element indicates the amount (%) of each element. Cu and Mn are indispensable elements, and Sn is contained if necessary. Because Sn is about 10 times as effective as Mn and Cu, the 10-fold Sn content (10×Sn) is equivalent to the Mn content and the Cu content. Less than 0.85% of (Mn+Cu+10×Sn) fails to provide a sufficient pearlite phase-stabilizing effect, resulting in insufficient strength such as tensile strength and yield strength, while more than 3% of (Mn+Cu+10×Sn) causes excess crystallization of pearlite phases, resulting in poor impact strength and elongation at low temperatures, and thus poor toughness. Accordingly, (Mn+Cu+10×Sn) is 0.85-3%. (Mn+Cu+10×Sn) is preferably 1.0-2.5%, more preferably 1.0-2.0%.

(8) P: 0.05% or Less

Because P is an element hindering the spheroidization of graphite, which is inevitably introduced from starting materials, its content should be 0.05% or less.

(9) S: 0.02% or Less

Because S is an element hindering the spheroidization of graphite, which is inevitably introduced from starting materials, its content should be 0.02% or less.

[B] Structure of Spheroidal Graphite Cast Iron (1) Matrix Structure

FIG. 1 is an optical photomicrograph showing the structure of the spheroidal graphite cast iron of the present invention. In FIG. 1, white portions 1 are ferrite phases, gray portions 2 are pearlite phases, and black spots 3 are spheroidal graphite particles. The spheroidal graphite cast iron of the present invention has a duplex matrix structure, in which fine ferrite phases and fine pearlite phases are distributed in a camouflage pattern (fine ferrite phases are dispersed in pearlite phases in an island-sea pattern). The area ratio of ferrite phases in the matrix structure is 2-40% (pearlite phases: 60-98%). The area ratio of ferrite phases in the matrix structure is preferably 20-40% (pearlite phases: 60-80%) when the spheroidal graphite cast iron is required to have high toughness, and preferably 2-10% (pearlite phases: 90-98%) when the spheroidal graphite cast iron is required to have high strength.

The fine pearlite phases are obtained by the transformation of fine crystal grains (austenite crystal grains) in a matrix completely austenized by an austenizing heat treatment to pearlite by cooling without being made coarser. The fine ferrite phases are formed along crystal grain boundaries of pearlite phases, by suppressing the crystallization and growth of ferrite phases not only by pearlite phase-stabilizing elements, but also by a heat treatment in a eutectoid transformation temperature range. Fine ferrite phases do not have network shapes, but have elongated shapes separated by pearlite crystal grains. Such shapes of ferrite phases may be called "dendritic."

In the duplex structure in which fine ferrite phases are divided by pearlite crystal grains, the degree of fineness of ferrite phases can be expressed by the maximum length of ferrite phases. Smaller maximum length of ferrite phases means that ferrite phases are more divided to smaller ones by pearlite crystal grains. Specifically, the maximum length of ferrite phases is preferably 300 μm or less. When the maximum length of ferrite phases is more than 300 μm, the ferrite phases are not regarded as "fine," so that the spheroidal graphite cast iron does not have sufficient strength due to the existence of coarse ferrite phases. The maximum length of ferrite phases is more preferably 200 μm or less, most preferably 150 μm or less. The maximum length of ferrite phases can be determined on an optical photomicrograph.

(2) Dispersion of Graphite Particles and Formation of Pearlite Phases in Duplex Structure Though a usual spheroidal graphite cast iron has a so-called "bull's eye structure," in which graphite particles are substantially surrounded by ferrite phases, the spheroidal graphite cast iron of the present invention has a duplex structure in which graphite particles are dispersed in fine ferrite phases and pearlite phases, the pearlite phases being formed around graphite particles, as shown in FIG. 1. Accordingly, ferrite phases are separated by pearlite phases around graphite particles.

The amount of pearlite phases crystallized around graphite particles is expressed by a pearlite-surrounded ratio (pearlitization ratio around graphite particles), which is defined as a percentage of the total length of peripheral portions of each graphite particle in contact with pearlite phases to its entire peripheral length. As the pearlite-surrounded ratio becomes higher, and as the numbers of graphite particles having a high pearlite-surrounded ratio becomes larger, the toughness, particularly low-temperature impact properties, of the spheroidal graphite cast iron are improved. In the spheroidal graphite cast iron of the present invention, the number ratio of graphite particles having pearlite-surrounded ratios of 50-95% is preferably 50% or more based on the total number of graphite particles per a unit area. When the number of such graphite particles is less than 50%, the spheroidal graphite cast iron has low impact properties at low temperatures, because of increase in interfaces between graphite particles and ferrite phases, which likely act as starting sites of cracking. The number ratio of graphite particles having pearlite-surrounded ratios of 50-95% is more preferably 60% or more, most preferably 70% or more. Graphite particles counted are those having equivalent-circle diameters of 5 μm or more. The measurements of the pearlite-surrounded ratio and the number ratio of graphite particles having pearlite-surrounded ratios of 50-95% per a unit area will be described later.

In the spheroidal graphite cast iron, cracking occurs mainly in crystal grain boundaries or in interfaces between the matrix and graphite particles, and energy absorbed in the process of breakage is a sum of crack-generating energy and crack-propagating energy. In general, most of the absorbed energy is crack-generating energy, whose percentage in the absorbed energy is higher as the matrix structure has higher hardness. The spheroidal graphite cast iron of the present invention having a structure with the above features (1) and (2) has excellent strength and toughness, because cracking is suppressed by the following functions.

(a) In the duplex structure, cracks are not easily generated, because fine pearlite crystal grains make smaller the accumulation of strain in grain boundaries when an external force is exerted.

(b) In the duplex structure in which ferrite phases are finely dispersed in pearlite phases, cracking energy is absorbed by the deformation of ferrite phases, because easily deformable ferrite phases and deformation-resistant pearlite phases exist alternately in crack-propagating paths.

(c) Because graphite particles are surrounded by high-strength pearlite phases, the matrix is strengthened near graphite particles, thereby suppressing cracking in interfaces between the matrix and graphite particles.

Specifically, the spheroidal graphite cast iron of the present invention preferably has tensile strength of 650 MPa or more and impact strength of 30 J/cm$^2$ or more by a notchless Charpy impact test at −30° C. The tensile strength is more preferably 700 MPa or more, most preferably 750 MPa or more. The impact strength by a notchless Charpy impact test at −30° C. is more preferably 40 J/cm$^2$ or more, most preferably 50 J/cm$^2$ or more.

To evaluate the properties of the spheroidal graphite cast iron of the present invention, 0.2-% yield strength may be used as an indicator of strength in place of tensile strength, and elongation may be used as an indicator of toughness in place of the Charpy impact strength. In this case, the spheroidal graphite cast iron of the present invention preferably has 0.2-% yield strength of 370 MPa or more and elongation of 8% or more. The 0.2-% yield strength of the spheroidal graphite cast iron of the present invention is more preferably 400 MPa or more, most preferably 430 MPa or more, and the elongation thereof is more preferably 12% or more, most preferably 13% or more.

[C] Production Method of Spheroidal Graphite Cast Iron

Figure 3:
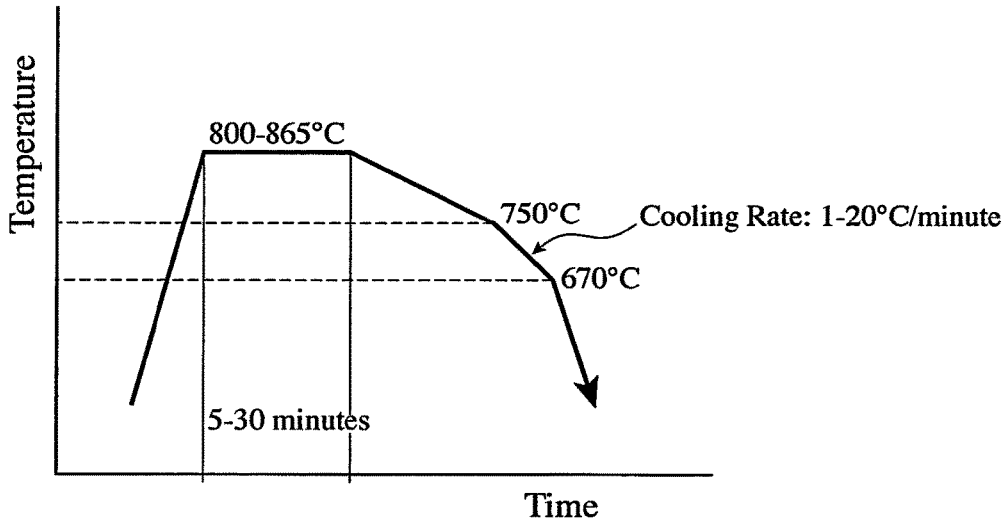
FIG. 3 is a graph schematically showing a heat treatment pattern for producing the spheroidal graphite cast iron of the present invention.

The production method of the spheroidal graphite cast iron of the present invention comprises (1) casting and solidifying a melt having a composition comprising by mass 3.4-4% of C, 1.9-2.8% of Si, 0.02-0.06% of Mg, 0.2-1% of Mn, 0.2-2% of Cu, 0-0.1% of Sn, 0.85-3% of (Mn+Cu+10× Sn), 0.05% or less of P, and 0.02% or less of S, the balance being Fe and inevitable impurities, and (2) conducting a heat treatment comprising a step (i) of holding the resultant casting at a temperature at which an entire matrix of the casting is austenized, to form fine austenite crystal grains, which are transformed to pearlite crystal grains by cooling, and a step (ii) of cooling the casting at a cooling rate of forming fine ferrite phases in a predetermined temperature range within a temperature span in which eutectoid transformation occurs, thereby forming a duplex matrix structure comprising by area 2-40% of fine ferrite phases and 60-98% of fine pearlite phases, the maximum length of the ferrite phases being 300 μm or less, and the pearlite phases being formed around graphite particles dispersed in the duplex matrix structure. In a temperature range lower than the eutectoid transformation temperature span, usual cooling may be conducted to room temperature. FIG. 3 schematically shows a heat treatment pattern for producing the spheroidal graphite cast iron of the present invention.

(1) Austenizing Heat Treatment Conditions [Step (a)]

The spheroidal graphite cast iron is kept at a temperature at which the entire matrix structure is completely austenized, to form fine austenite crystal grains, which are transformed to pearlite crystal grains by cooling. This austenization temperature is preferably 800-865° C. When this temperature is lower than 800° C., ferrite phases are formed from the remaining pearlite phases and grow by cooling to the eutectoid transformation temperature range, resulting in coarser crystal grains and low strength. On the other hand, when this temperature is higher than 865° C., austenite crystal grains (transformed to pearlite crystal grains by cooling) are made coarser, resulting in poor toughness, particularly impact properties at low temperatures, and large heat treatment strain. The austenization temperature-holding time is preferably 5-30 minutes, though variable depending on the holding temperature. The holding time of less than 5 minutes unlikely causes complete austenization, resulting in low strength by the growth of ferrite phases, while the holding time of more than 30 minutes makes austenite crystal grains coarser, failing to obtain fine pearlite phases by cooling, thus resulting in poor toughness and large heat treatment strain. The austenizing heat treatment temperature is preferably 800-860° C., more preferably 800-855° C. The austenizing heat treatment time is preferably 10-25 minutes.

(2) Heat Treatment Conditions in Eutectoid Transformation Temperature Range [Step (b)]

When the completely austenized spheroidal graphite cast iron is cooled at a cooling rate forming fine ferrite phases in a predetermined temperature range within a temperature span in which eutectoid transformation occurs, the matrix structure is turned to a duplex structure comprising by area 2-40% of fine ferrite phases and 60-98% of fine pearlite phases, the ferrite phases having the maximum length of 300 μm or less, and the pearlite phases being formed around graphite particles dispersed in the duplex matrix structure. The temperature span in which eutectoid transformation occurs (eutectoid transformation temperature span) is a temperature span from a temperature $Ar_3$, at which the transformation of austenite to ferrite starts, to a temperature (eutectoid transformation temperature) $Ar_1$, at which the transformation of austenite to ferrite or ferrite and cementite is completed, in a cooling process in the heat treatment. The predetermined temperature range within the temperature span, in which eutectoid transformation occurs, is preferably 750-670° C. Cooling at a predetermined rate described later in a temperature range of 750-670° C. provides the duplex structure. The upper limit of the predetermined temperature range may be 730° C.

The cooling rate in a predetermined temperature range within a temperature span, in which eutectoid transformation occurs, is important to form not only a duplex matrix structure, but also pearlite phases around graphite particles. Specifically, it is preferably 1-20° C./minute. When the cooling rate is less than 1° C./minute, ferritization around graphite particles is accelerated, failing to obtain fine ferrite phases, resulting in low strength. On the other hand, when the cooling rate exceeds 20° C./minute, ferrite phases are not sufficiently formed in pearlite crystal grain boundaries, resulting in poor impact properties at low temperatures, and insufficient toughness. The more preferred cooling rate is 5-15° C./minute. A temperature pattern in the predetermined temperature range within a eutectoid-transformation-causing temperature span may be continuous cooling at a constant cooling rate or intermittent cooling, as long as fine ferrite phases are formed neither too much nor too little in pearlite crystal grain boundaries, with pearlite phases formed around graphite particles. After the heat treatment in a eutectoid transformation temperature range, the spheroidal graphite cast iron is cooled to room temperature. The cooling rate from the austenization temperature to the eutectoid transformation temperature span is preferably 2-20° C./minute.

The present invention will be explained in more detail with Examples below, without intention of restricting the present invention thereto. Unless otherwise mentioned particularly, the amount of each element constituting the alloy is expressed by "% by mass."

Starting materials comprising pig iron, steel sheet scraps and spheroidal graphite cast iron return scraps were melted in a high-frequency melting furnace having a capacity of 100 kg, and a recarburizer, pearlite phase-stabilizing elements and an Fe—Si alloy were add to the melt for component adjustment. The resultant melt was poured at about 1500° C. into a ladle containing an Fe—Si—Mg alloy as a graphite-spheroidizing agent and covered with a steel plate scrap, and spheroidization was conducted by a sandwiching method. The spheroidized melt was cast at about 1400° C. into a sand mold to form pluralities of 1-inch Y blocks.

During casting, Fe—Si alloy powder was added to the flowing melt for inoculation. Thus, spheroidal graphite cast irons each having the composition shown in Table 1 were obtained. The cast irons A to I are spheroidal graphite cast irons within the composition range of the present invention, and the cast irons J to L are those outside the composition range of the present invention. Among the cast irons A to L, the cast iron A is a spheroidal graphite cast iron within the composition range disclosed by JP 8-13079A. The cast iron F corresponds to FCD700 having a pearlite matrix, and the cast iron K corresponds to FCD450 having a ferrite matrix, both being conventional spheroidal graphite cast irons when as-cast.

TABLE 1

| Cast | Composition[(1)] | | | | | | | | |
|---|---|---|---|---|---|---|---|---|---|
| Iron | C | Si | Mn | Cu | Sn | Mg | P | S | Mn + Cu + 10 Sn |
| A | 3.48 | 2.45 | 0.25 | 0.61 | 0.000 | 0.037 | 0.018 | 0.012 | 0.86 |
| B | 3.45 | 2.25 | 0.65 | 0.20 | 0.000 | 0.030 | 0.012 | 0.011 | 0.85 |
| C | 3.61 | 2.19 | 0.40 | 0.41 | 0.006 | 0.036 | 0.016 | 0.009 | 0.87 |
| D | 3.68 | 2.35 | 0.38 | 0.56 | 0.000 | 0.038 | 0.020 | 0.007 | 0.94 |
| E | 3.70 | 2.28 | 0.56 | 0.52 | 0.000 | 0.035 | 0.009 | 0.009 | 1.08 |
| F | 3.75 | 2.23 | 0.45 | 0.81 | 0.000 | 0.037 | 0.015 | 0.008 | 1.26 |
| G | 3.73 | 2.21 | 0.66 | 0.84 | 0.000 | 0.032 | 0.013 | 0.013 | 1.50 |
| H | 3.65 | 2.45 | 0.71 | 1.51 | 0.000 | 0.039 | 0.015 | 0.010 | 2.22 |
| I | 3.77 | 2.78 | 0.78 | 1.80 | 0.025 | 0.041 | 0.016 | 0.008 | 2.83 |
| J* | 3.63 | 2.24 | 0.30 | 0.25 | 0.000 | 0.038 | 0.018 | 0.010 | 0.55 |
| K* | 3.77 | 2.21 | 0.48 | 0.32 | 0.000 | 0.037 | 0.014 | 0.012 | 0.80 |
| L* | 3.80 | 2.75 | 1.04 | 2.13 | 0.000 | 0.042 | 0.013 | 0.009 | 3.17 |

Note:
[(1)]The balance are Fe and inevitable impurities.
*Outside the present invention.

A sample of about 25 mm×about 25 mm in cross section and about 170 mm in length was cut out of a lower portion of a Y block made of each of the above cast irons A-L, and subjected to an austenizing heat treatment and a heat treatment in a eutectoid transformation temperature range under the conditions shown in Table 2. In Table 2, Samples having alphabets with single-digit or ten-odd numbers such as A1, B1 . . . E10, E11 are samples heat-treated under the conditions of the present invention, and Samples having alphabets with 50-odd numbers such as A51, D51 . . . L51 are samples heat-treated under the conditions outside the present invention. Sample A51 is a sample heat-treated for austenization under the same conditions as described in JP 8-13079 A. Sample D51 is a sample heat-treated in a eutectoid transformation temperature range under the same conditions as described in JP 2001-214233 A. Sample F51 is an as-cast sample of the cast iron F corresponding to FCD700, and Sample K52 is an as-cast sample of the cast iron K corresponding to FCD450. The following tests were conducted on each sample.

(1) Structure

Figure 2:
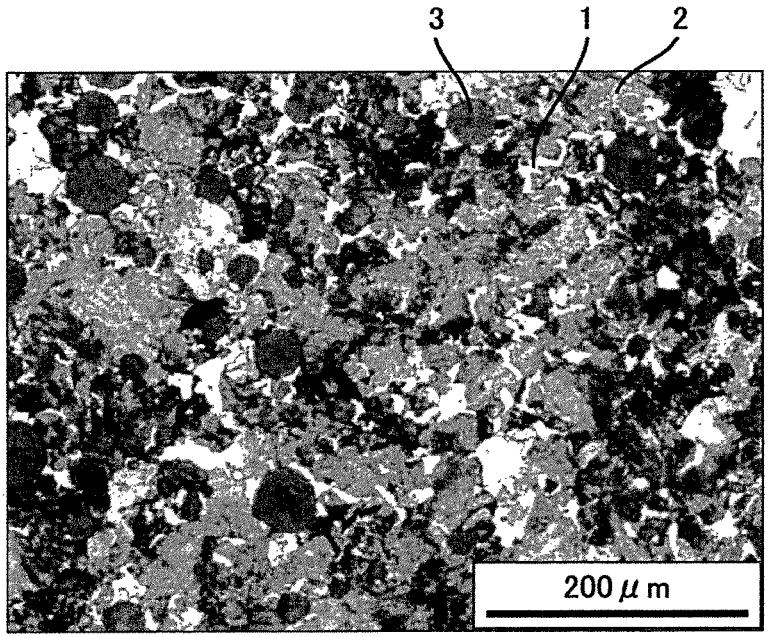
FIG. 2 is an optical photomicrograph showing the structure of the spheroidal graphite cast iron of the present invention.

FIGS. 1 and 2 are optical photomicrographs showing the structure of Sample F1 (spheroidal graphite cast iron of the present invention). In FIGS. 1 and 2, white portions 1 are ferrite phases, gray portions 2 are pearlite phases, and black spots 3 are spheroidal graphite. As shown in FIGS. 1 and 2, the spheroidal graphite cast iron of the present invention had a matrix structure having fine ferrite phases and fine pearlite phases mixed in a complicated manner, in which spheroidal graphite particles were dispersed, with pearlite phases formed therearound. The observation results of the structure of each sample are shown in Table 2.

In the structure of each sample, the maximum length of ferrite phases and the number ratio of graphite particles having pearlite-surrounded ratios of 50-95% were determined. The maximum length of ferrite phases was determined by describing a contour of the longest ferrite phase in a field (530 μm×710 μm) of an optical photomicrograph (magnification: 100 times) of the structure on a tracing paper, drawing a straight line connecting the maximum-distance points on the contour, and measuring the length of the straight line by an image analyzer (IP-1000 available from Asahi Kasei Corporation).

The pearlite-surrounded ratio was determined by counting the total number Na of graphite particles having equivalent-circle diameters of 5 μm or more among those in a field observed by an optical microscope, describing the contours of graphite particles counted and the contours of pearlite phases in contact with such graphite particles on a tracing paper, measuring the peripheral length Lg of each graphite particle, and the total length Lp of portions of each graphite particle in contact with pearlite phases by the above image analyzer, calculating Lp/Lg×100(%), and averaging the calculated values on all graphite particles counted. The number ratio of graphite particles having pearlite-surrounded ratios of 50-95% was determined by counting the number Np of graphite particles having pearlite-surrounded ratios of 50-95%, and calculating Np/Na×100(%). The maximum length of ferrite phases and the number ratio of graphite particles having pearlite-surrounded ratios of 50-95% are averages of values determined in five arbitrary fields. The results are shown in Table 2.

(2) Tensile Test

Test pieces of JIS Z 2201 14A were produced from each sample, and subjected to tensile tests at room temperature according to JIS Z 2241 by an Amsler tensile test machine (AG-IS250kN available from Shimadzu Corporation), to measure their tensile strength, 0.2-% yield strength and elongation. The results are shown in Table 2.

(3) Charpy Impact Test

Flat, notchless test pieces of 55 mm in length, 10 mm in height and 10 mm in width for a Charpy impact test were produced from each sample, to measure their Charpy impact strength at −30° C. according to JIS Z 2242 by an impact test machine (300CR available from Yonekura Mfg. Co. Ltd.). The results are shown in Table 2.

TABLE 2

| Cast Iron | Sample | Heat Treatment for Austenization: Holding Temp. (° C.) | Heat Treatment for Austenization: Holding Time (minutes) | Treatment in Eutectoid Transformation Temperature: Range (750-670° C.) Cooling Rate (° C./minute) |
|---|---|---|---|---|
| A | A1 | 850 | 25 | 20 |
| | A51* | 870 | 60 | 1.5 |
| B | B1 | 800 | 5 | 20 |
| C | C1 | 850 | 20 | 15 |
| D | D1 | 850 | 20 | 8 |
| | D51* | 850 | 20 | 50 |
| E | E1 | 800 | 5 | 1 |
| | E2 | 800 | 5 | 10 |
| | E3 | 800 | 5 | 20 |
| | E4 | 850 | 20 | 1 |
| | E5 | 850 | 20 | 3 |
| | E6 | 850 | 20 | 5 |
| | E7 | 850 | 20 | 10 |
| | E8 | 850 | 20 | 13 |
| | E9 | 850 | 20 | 15 |
| | E10 | 850 | 20 | 20 |
| | E11 | 865 | 25 | 1 |
| | E12 | 865 | 25 | 10 |
| | E13 | 865 | 25 | 20 |
| | E51* | 790 | 25 | 20 |
| | E52* | 870 | 5 | 1 |
| F | F1 | 850 | 20 | 10 |
| | F51* | As-cast | As-cast | As-cast |
| G | G1 | 850 | 20 | 8 |
| H | H1 | 850 | 20 | 5 |
| I | I1 | 800 | 5 | 1 |
| J* | J51* | 850 | 20 | 10 |
| K* | K51* | 850 | 20 | 10 |
| | K52* | As-cast | As-cast | As-cast |
| L* | L51* | 800 | 5 | 1 |

Note:
Spheroidal graphite cast irons and samples with * are outside the scope of the present invention.

| Cast Iron | Sample | Structure: Area Ratio of Pearlite Phases (1) (%) | Structure: Percentage of Graphite (2) (%) | Structure: Maximum Length of Ferrite (μm) |
|---|---|---|---|---|
| A | A1 | 62 | 56 | 285 |
| | A51* | 57 | 37 | 452 |
| B | B1 | 82 | 59 | 247 |
| C | C1 | 75 | 57 | 221 |
| D | D1 | 91 | 65 | 193 |
| | D51* | 86 | 0 | 314 |
| E | E1 | 90 | 54 | 275 |
| | E2 | 93 | 61 | 186 |
| | E3 | 96 | 67 | 160 |
| | E4 | 93 | 63 | 208 |
| | E5 | 94 | 68 | 175 |
| | E6 | 95 | 72 | 147 |
| | E7 | 97 | 85 | 122 |
| | E8 | 96 | 88 | 116 |
| | E9 | 98 | 87 | 113 |
| | E10 | 97 | 86 | 98 |
| | E11 | 92 | 60 | 215 |
| | E12 | 95 | 75 | 134 |
| | E13 | 97 | 88 | 106 |
| | E51* | 58 | 48 | 332 |
| | E52* | 75 | 42 | 417 |
| F | F1 | 97 | 88 | 109 |
| | F51* | 98 | 0 | 324 |
| G | G1 | 98 | 81 | 105 |
| H | H1 | 97 | 90 | 93 |
| I | I1 | 98 | 92 | 84 |
| J | J51* | 0 | 0 | 678 |
| K | K51* | 56 | 15 | 304 |
| | K52* | 52 | 0 | 307 |
| L | L51* | 100 | 93 | 81 |

TABLE 2-continued

Note:
(1) The area ratio (%) of ferrite phases is (100 − the area ratio of pearlite phases).
(2) Graphite particles having pearlite-surrounded ratios of 50-95%.
*Outside the range of the present invention.

| Cast Iron | Sample | Properties: Tensile Strength (MPa) | Properties: 0.2-% Yield Strength (MPa) | Properties: Impact Strength (1) (J/cm$^2$) | Properties: Elongation (%) |
|---|---|---|---|---|---|
| A | A1 | 658 | 375 | 68.2 | 14.8 |
| | A51* | 604 | 332 | 29.0 | 10.5 |
| B | B1 | 683 | 394 | 61.9 | 14.6 |
| C | C1 | 675 | 388 | 60.3 | 14.0 |
| D | D1 | 708 | 405 | 53.7 | 13.8 |
| | D51* | 735 | 425 | 19.5 | 6.0 |
| E | E1 | 659 | 377 | 65.1 | 14.2 |
| | E2 | 713 | 414 | 57.4 | 12.4 |
| | E3 | 731 | 428 | 53.2 | 12.0 |
| | E4 | 682 | 386 | 66.6 | 14.1 |
| | E5 | 694 | 395 | 58.9 | 13.8 |
| | E6 | 756 | 442 | 56.2 | 13.0 |
| | E7 | 824 | 508 | 53.8 | 12.3 |
| | E8 | 835 | 513 | 51.3 | 12.1 |
| | E9 | 851 | 529 | 50.5 | 12.0 |
| | E10 | 862 | 537 | 49.6 | 11.6 |
| | E11 | 677 | 388 | 64.0 | 13.5 |
| | E12 | 801 | 476 | 51.5 | 12.1 |
| | E13 | 865 | 542 | 48.6 | 11.7 |
| | E51* | 618 | 350 | 44.1 | 13.8 |
| | E52* | 632 | 361 | 28.5 | 7.8 |
| F | F1 | 850 | 533 | 52.3 | 12.5 |
| | F51* | 856 | 529 | 13.3 | 4.0 |
| G | G1 | 848 | 533 | 45.4 | 11.8 |
| H | H1 | 868 | 545 | 38.2 | 9.2 |
| I | I1 | 884 | 538 | 35.7 | 8.0 |
| J* | J51* | 509 | 302 | 75.4 | 19.5 |
| K* | K51* | 637 | 363 | 38.5 | 11.3 |
| | K52* | 629 | 354 | 39.2 | 12.1 |
| L* | L51* | 866 | 546 | 15.1 | 3.2 |

Note:
(1) Measured at −30° C.
*Outside the range of the present invention.

As shown in Table 2, among the samples of the cast irons A-I within the composition range of the present invention, any of Samples A1-I1 heat-treated under the conditions of the present invention had a duplex structure having fine ferrite phases and fine pearlite phases mixed in a camouflage pattern, with the maximum length of ferrite phases being 300 μm or less, and the number ratio of graphite particles having pearlite-surrounded ratios of 50-95% being 50% or more, and had tensile strength of 650 MPa or more and notchless Charpy impact strength of 30 J/cm$^2$ or more at −30° C. It was found from these data that Samples A1-I1 within the scope of the present invention had high strength and toughness.

Particularly, any of Samples D1, E2, E3, E6 to E10, E12, E13, F1, G1, H1 and I1, which contained 0.9% or more of (Mn+Cu+10×Sn) and produced at a cooling rate of 5° C./minute or more in a eutectoid transformation temperature range, had tensile strength of 700 MPa or more. It is clear from Table 2 that larger amounts of pearlite phase-stabilizing elements and higher cooling rates in a eutectoid transformation temperature range provide improved strength.

On the other hand, Samples J51 and K51 with small amounts of pearlite phase-stabilizing elements contained, which are outside the composition range of the present invention, had as low tensile strength as 509 MPa and 637 MPa, respectively, even if they were heat-treated under the conditions of the present invention. Sample L51 with large amounts of pearlite phase-stabilizing elements contained, which are outside the composition range of the present invention, had as low impact strength as 15.1 J/cm$^2$ despite as high tensile strength as 866 MPa, failing to meet the demand of having both high strength and high toughness. Sample E51 having a composition within the present invention but produced at an austenization temperature of 790° C., lower than that of the present invention, had as low tensile strength as 618 MPa. This appears to be due to the fact that because too low an austenization temperature made pearlite phases remain, ferrite phases grew from the remaining pearlite phases by cooling to a eutectoid transformation temperature span, resulting in coarser crystal grains.

Except for Samples H1 and I1 respectively containing 2.22% and 2.83% of (Mn+Cu+10×Sn), Samples A1 to G1 within the composition range of the present invention had notchless Charpy impact strength of 40 J/cm$^2$ or more at −30° C. Sample K52 outside the present invention, which is a spheroidal graphite cast iron having a ferrite matrix corresponding to as-cast (not heat-treated) FCD450, had notchless Charpy impact strength of 39.2 J/cm$^2$. This revealed that Samples A1 to G1 of the present invention had impact strength equal to or higher than that of FCD450. Both of Samples F1 and F51 were made of the cast iron F (corresponding to FCD700) containing 1.26% of (Mn+Cu+10×Sn), Sample F1 being subjected to a heat treatment under the conditions of the present invention, and as-cast Sample F51 having a pearlite matrix. The measurements revealed that Sample F1 of the present invention had tensile strength on the same level as that of Sample F51, and as high impact strength as 52.3 J/cm$^2$, about 4 times the impact strength (13.3 J/cm$^2$) of Sample F51.

Sample A51 having a composition within the present invention but produced by a high-temperature, long-time austenization heat treatment at 870° C. for 60 minutes as in JP 8-13079 A had as low impact strength as 10.5 J/cm$^2$. Sample E52 produced at as high an austenization temperature as 870° C. had as low impact strength as 7.8 J/cm$^2$. Low impact strength in Samples A51 and E52 appears to be due to the fact that a high austenization temperature made austenite crystal grains (transformed to pearlite crystal grains after cooling) coarser, resulting in low toughness.

Sample D51 within the composition range of the present invention was heat-treated in a eutectoid transformation temperature range under the same conditions as in JP 2001-214233 A. The heat treatment condition of Sample D51 in a temperature range of 750-670° C. within a eutectoid transformation temperature span was air-cooling at a cooling rate of 50° C./minute. As a result, Sample D51 had as low impact strength as 19.5 J/cm$^2$ despite high tensile strength. This appears to be due to the fact that too large a cooling rate in a eutectoid transformation temperature range fails to provide sufficient formation of ferrite phases in pearlite crystal grain boundaries, resulting in low toughness.

It has been confirmed from above that the spheroidal graphite cast iron of the present invention having tensile strength on the same level as that of FCD700 and impact strength on the same level as that of FCD450 is a spheroidal graphite cast iron having excellent strength and toughness.

EFFECTS OF THE INVENTION

Because the spheroidal graphite cast iron of the present invention has a duplex matrix structure comprising by area 2-40% of fine ferrite phases and 60-98% of fine pearlite phases, the maximum length of the ferrite phases being 300 μm or less, and the pearlite phases being formed around graphite particles dispersed in the duplex matrix structure, it has excellent strength and toughness, suitable for automobile parts, particularly for suspension parts requiring high impact resistance at low temperatures, contributing to reducing the fuel consumption of automobiles with lighter-weight parts.

What is claimed is:

1. A spheroidal graphite cast iron having excellent strength and toughness, which has (a) a composition comprising by mass 3.4-4% of C, 1.9-2.8% of Si, 0.02-0.06% of Mg, 0.2-1% of Mn, 0.2-2% of Cu, 0.85-3% of (Mn+Cu), 0.05% or less of P, and 0.02% or less of S, the balance being Fe and inevitable impurities, wherein Sn is not present in the composition; and (b) a duplex matrix structure comprising by area 2-40% of fine ferrite phases and 60-98% of fine pearlite phases, the maximum length of said ferrite phases being 300 μm or less; and (c) said pearlite phases being formed around graphite particles dispersed in said duplex matrix structure.

2. The spheroidal graphite cast iron having excellent strength and toughness according to claim 1, wherein the number ratio of graphite particles each having a pearlite-surrounded ratio (defined as a percentage of the total length of peripheral portions of each graphite particle in contact with pearlite phases to its entire peripheral length) of 50-95% is 50% or more based on the total number of graphite particles per a unit area.

3. The spheroidal graphite cast iron having excellent strength and toughness according to claim 1, which has tensile strength of 650 MPa or more, and impact strength of 30 J/cm$^2$ or more by a notchless Charpy impact test at −30° C.

4. A method for producing a spheroidal graphite cast iron having excellent strength and toughness comprising the steps of (1) casting and solidifying a melt having a composition comprising by mass 3.4-4% of C, 1.9-2.8% of Si, 0.02-0.06% of Mg, 0.2-1% of Mn, 0.2-2% of Cu, 0.85-3% of (Mn+Cu), 0.05% or less of P, and 0.02% or less of S, the balance being Fe and inevitable impurities, wherein Sn is not present in the composition; and (2) conducting a heat treatment comprising a step (i) of holding the resultant casting at a temperature at which an entire matrix of the casting is austenized, to form fine austenite crystal grains, which are transformed to pearlite crystal grains by cooling, and a step (ii) of cooling the casting at a cooling rate of forming fine ferrite phases in a predetermined temperature range within a temperature span in which eutectoid transformation occurs, thereby forming a duplex matrix structure comprising by area 2-40% of fine ferrite phases and 60-98% of fine pearlite phases, the maximum length of said ferrite phases being 300 μm or less, and said pearlite phases being formed around graphite particles dispersed in said duplex matrix structure.

5. The method for producing a spheroidal graphite cast iron having excellent strength and toughness according to claim 4, wherein fine austenite crystal grains are formed at a temperature of 800-865° C. in 5-30 minutes; wherein said predetermined temperature range within a eutectoid-transformation-causing temperature span is 750-670° C.; and wherein said cooling rate in the predetermined temperature range within a eutectoid-transformation-causing temperature span is 1-20° C./minute.

* * * * *